US011084302B2

(12) United States Patent
Ohnishi

(10) Patent No.: US 11,084,302 B2
(45) **Date of Patent: *Aug. 10, 2021**

(54) INKJET PRINTING APPARATUS

(71) Applicant: MIMAKI ENGINEERING CO., LTD., Nagano (JP)

(72) Inventor: Masaru Ohnishi, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/924,197

(22) Filed: Jul. 9, 2020

(65) Prior Publication Data

US 2020/0338914 A1 Oct. 29, 2020

Related U.S. Application Data

(63) Continuation of application No. 16/273,177, filed on Feb. 12, 2019, now Pat. No. 10,744,804.

(30) Foreign Application Priority Data

Feb. 16, 2018 (JP) ..... JP2018-025675

(51) Int. Cl.

| | |
|---|---|
| ***B41J 3/407*** | (2006.01) |
| ***B41J 25/00*** | (2006.01) |
| ***B41J 19/20*** | (2006.01) |
| ***B41J 19/14*** | (2006.01) |
| ***B41J 11/20*** | (2006.01) |
| ***B41J 29/377*** | (2006.01) |
| ***B41J 25/308*** | (2006.01) |

(52) U.S. Cl.

CPC ..... *B41J 25/001* (2013.01); *B41J 3/4078* (2013.01); *B41J 11/20* (2013.01); *B41J 19/145* (2013.01); *B41J 19/202* (2013.01); *B41J 25/308* (2013.01); *B41J 29/377* (2013.01)

(58) Field of Classification Search

CPC ..... B41J 25/001; B41J 25/308; B41J 25/304; B41J 3/4078; B41J 11/20; B41J 19/145; B41J 19/202; B41J 29/317

See application file for complete search history.

(56) References Cited

U.S. PATENT DOCUMENTS

2019/0255866 A1* 8/2019 Ohnishi ..... B41J 19/145

* cited by examiner

*Primary Examiner* — Alejandro Valencia
(74) *Attorney, Agent, or Firm* — JCIPRNET

(57) ABSTRACT

An inkjet printing apparatus includes a mounting unit where a recording medium is mountable, a head unit that ejects ink droplets to the recording medium, a planar direction driving unit that drives at least one of the head unit ejecting the ink droplets and the mounting unit to move in a planar direction and that changes a relative positions of the head unit and the mounting unit in the planar direction, and a height direction driving unit that changes a relative positions of the head unit and the mounting unit in a height direction perpendicular to the planar direction. The planar direction driving unit has a moving speed changing mechanism that changes a carriage speed between the head unit and the mounting unit in the planar direction. The height direction driving unit has a distance changing mechanism that changes a distance between the head unit and the mounting unit.

6 Claims, 6 Drawing Sheets

| Head gap | Carriage speed | Printing mode | Atmosphere in ink droplet flying space |
|---|---|---|---|
| Small | Fast | First printing mode | Air |
| | | | Helium |
| | | | Pressure reduction |
| Large | Slow | Second printing mode | Air |
| | | | Helium |
| | | | Pressure reduction |
| | Fast | Third printing mode | Air |
| | | | Helium |
| | | | Pressure reduction |

INKJET PRINTING APPARATUS

CROSS REFERENCE TO RELATED APPLICATIONS

This application is a continuation application of and claims the priority benefit of a prior application Ser. No. 16/273,177, filed on Feb. 12, 2019, now allowed. The prior application claims the priority benefit of Japanese Patent Application No. 2018-025675, filed on Feb. 16, 2018. The entirety of the above-mentioned patent application is hereby incorporated by reference herein and made a part of this specification.

TECHNICAL FIELD

This disclosure relates to an inkjet printing apparatus.

DESCRIPTION OF THE BACKGROUND ART

Industrial applications of use of inkjet printers include wide format printers for digital textile and sign graphics developed in early stages, and are further expanding in recent years into a broader range of industrial and technical fields, for example, digital printing and digital decoration required to deal with different demands ranging from mass production to individual production (production by order).

Among the conventional analog-based printing applications, transition to digital printing is going well with, especially, POD (print-on-demand) mostly targeted for individual printing needs. Yet, analog printing is still a mainstream printing technique in industrial fields and products prioritized in image quality and higher resolution and precision for better marketability.

FIG. 5A is an upper view of a conventional inkjet printing apparatus 101. The inkjet printing apparatus 101 has a head unit 105 from which ink is ejected, and a mounting unit 110 disposed so as to face the head unit 105. The mounting unit 110 supports a lower part of a recording medium 140. The head unit 105 is guided along a guide rail 107 by a main scan driving unit 125 controlled by a controller 120 to perform scans in a main scanning direction (main scans), specifically, Y direction illustrated in FIG. 5A. A sub scan driving unit 155 controlled by the controller 120 drives the head unit 105 to perform scans in a sub scanning direction (sub scans), specifically, X direction illustrated in FIG. 6A. When the head unit 105 is moving fast during the main scans (see FIG. 5B described later), the movement and resulting vibration of the head unit 105 may undermine desired sharpness of a print result.

FIG. 5B is a drawing that illustrates a head gap G in the conventional inkjet printing. FIG. 5B is a front view of the conventional inkjet printing apparatus 101. In the conventional inkjet printing apparatus 101, the head gap G between the head unit 105 and an upper surface of the mounting unit 110 in Z direction on the drawing may be approximately 3 mm. Therefore, any recording mediums having thicknesses W of 1 mm or more may be difficult to use. Therefore, textile printing using thick mediums such as fabric may be often difficult to perform with the inkjet printing apparatus 101.

Japanese Patent No. 5280073 describes a technique to decrease air resistance against ink droplets ejected from the head unit 105 through pressure reduction in a space between the head unit 105 and the mounting unit 110 to allow the ink droplets to land at predesignated positions with higher accuracy even when the head unit and the upper surface of the mounting unit are spaced apart with a larger head gap G.

SUMMARY

There are issues, however, with the technique described in Japanese Patent No. 5280073. One of the issues is that vapor pressure resulting from components of the ejected ink may only allow the pressure reduction to a limited range. The other issue is that the pressure reduction, if overdone, may finally change properties of the ink. In any industrial and technical fields that demand higher resolution and precision, transition from analog printing to inkjet printing is rather slow, because digital printers for inkjet printing may have the following issues yet to be addressed.

Issue 1: Lower Resolution than Analog Printing

Approximately 2 pL to 3 pL may be the acceptable largest size of ink droplets that can be stably ejected on demand from an inkjet head of any inkjet serial or line printer, because smaller ink droplets are more likely to decelerate under air resistance and are more affected by crosswind generated by the movement of the head, which may cause the ink droplets to land at inaccurate positions mostly in the direction in which the head moves (hereinafter, Y direction).

FIG. 6 is a drawing that illustrates how a scan by the head unit 105 affects the trajectory of an ink droplet 160. Supposing that the ink droplet 160 is ejected from the head unit 105 downward in the Z direction at a longitudinal ejection speed $V_i$ and a scan is performed then by the head unit 105 at a transverse speed $V_Y$ in the Y direction, the ink droplet 160 flies at a composite speed V of the speeds $V_i$ and $V_Y$. Then, the ink droplet 160 is directed toward "F", instead of "C" which is the originally desired landing position of the ink droplet 160. The ink droplet 160 may be affected by a force "Fr" due to air resistance in addition to being affected by a gravity "Fg" downward in the Z direction, which may cause variability of the direction of the ejected ink droplet 160. The landing position of the ink droplet 160, which is supposed to be the originally desired landing position "C", may shift through degrees of variability θ to a position between "A" and "B", as illustrated in FIG. 6. The inkjet printing, therefore, may be difficult to print lines of 60 μm or less in width. Another issue to be addressed with the inkjet printing is that such instability of the ink droplet landing positions degrades sharpness of a print result to as low as approximately a fraction of that of an analog print result. Thus, sharp, high-resolution images may be conventionally difficult to obtain with the inkjet printing.

Issue 2: Image Sharpness and Resolution May be Even More Degraded with High-Speed Printing and Wide-Gap Printing With more distance between head nozzles and a print medium, ink droplets may more rapidly decelerate. In case the size, initial speed, and ejection angle of ink droplets are inconstant, therefore, the landing positions may become more variable and more inaccurate under the impact from crosswind that increases with higher printing speeds, and a print result may lose desirable sharpness and resolution.

FIG. 7 is a drawing that illustrates issues to be addressed with a recording medium 140 with large irregularities. Typically, textile mediums, such as fabric and woven fabric, are thick and have very uneven surfaces. In such a medium, a distance between the head unit 105 and an upper surface 165 of the mounting unit (head gap G) may desirably be increased, meaning that the wide-gap printing is desirably employed. The recording medium 140, however, may have large depths D at some positions, which may be greatly affected by variability of the size, initial speed, and ejection angle of ink droplets. Then, a print result may inevitably have poor sharpness.

Thus, the wide-gap printing may be conventionally difficult to print high-resolution, sharp, and clear images at high speeds on mediums with such large irregularities and long-pile fabrics.

This disclosure provides an inkjet printing apparatus that may address the issue of the known art that all of high resolution, high printing speed, and large head gap are not feasible in one inkjet printer.

TECHNICAL SOLUTIONS

This disclosure provides a plurality of printing modes. One of the printing modes is in charge of high-speed, high-resolution printing of the known art, and the other printing modes are in charge of printing control with a greater head gap and a lower main scanning speed not to lose sharpness of a print result. In one of the other printing modes, an ink droplet flying space between a head unit and a recording medium is supplied with any gas but air, for example, helium gas. By having these printing modes selectively switched to one another, high resolution, high printing speed, and large head gap are all feasible in one inkjet printing apparatus.

Specifically, this disclosure provides the following technical aspects.

Aspect 1: Three printing modes are provided; regular printing mode, high-resolution and wide-gap printing mode, and super wide-gap printing mode.

Aspect 2: These three printing modes are defined as below.

1) Regular printing mode (high-speed printing mode): printing mode in which conventional one-pass scans or multi-pass scans are performed.

2) High-resolution and wide-gap printing mode (low-speed printing mode): printing mode in which a scanning speed of a head that moves relative to a medium (recording medium) is decreased to, for example, one-hundredth or less of an initial ejection speed of ink droplets, or scanning is temporarily suspended at the time of ejection of ink droplets.

2) Super wide-gap printing mode (helium-gas atmosphere printing mode): printing mode in which at least a space between positions of ejection and landing of ink droplets is supplied with helium gas, and the scanning speed of the head that moves relative to the medium is decreased to, for example, one-hundredth or less of the initial ejection speed of ink droplets, or scanning is temporarily suspended at the time of ejection of ink droplets.

This disclosure provides a method in which the three printing modes are selectively set to offer different printing options; high-speed printing, high-resolution and wide-gap printing, and super wide-gap printing, depending on applications of use and purposes.

This disclosure further provides a high-value-added inkjet printing apparatus that may improve printing safety and that may be combined with laser cutting printers that leave no burn mark.

1) An inkjet printing apparatus is provided that includes a mounting unit having a flat shape on which a recording medium is mountable; a head unit that ejects ink droplets to the recording medium; a planar direction driving unit that drives at least one of the head unit ejecting the ink droplets and the mounting unit to move in a planar direction parallel to the mounting unit and that changes a relationship between relative positions of the head unit and the mounting unit in the planar direction; and a height direction driving unit that changes a relationship between relative positions of the head unit and the mounting unit in a height direction perpendicular to the planar direction. The planar direction driving unit has a moving speed changing mechanism that changes a carriage speed between the head unit and the mounting unit in the planar direction. The height direction driving unit has a distance changing mechanism that changes a distance between the head unit and the mounting unit (head gap). The inkjet printing apparatus further includes a controller that controls the carriage speed changed by the moving speed changing mechanism based on the distance changed and set by the distance changing mechanism.

In the printing apparatus according to the aspect 1) provided with the distance changing mechanism to change a relative distance between the head unit and the mounting unit (head gap), recording mediums large in thickness may be used in this printing apparatus through adjustment of the distance between the head unit and the mounting unit. Further, the carriage speed between the head unit and the mounting unit is controlled by the moving speed changing mechanism based on the distance between the head unit and the mounting unit changed and set by the distance changing mechanism. This may allow the speed of a carriage; main scanning speed of the head unit, to be optimized depending on different conditions such as head gap. Thus, a high-quality print result may be obtained.

2) The inkjet printing apparatus further includes a mode storage in which a plurality of printing modes under different conditions are storable. The plurality of printing modes include a first printing mode in which a head gap which is a distance between the head unit and the mounting unit is relatively small, and a second printing mode in which the head gap is greater than in the first printing mode and the carriage speed is lower than in the first printing mode.

In the printing apparatus according to the aspect 2), the distance between the head unit and the mounting unit may be changed to, for example, 3 mm or more in the second printing mode, recording mediums large in thickness, such as textile mediums, may be used as print medium. By slowing down the carriage speed, the printing operation may be less affected by a transverse (Y direction) speed $V_Y$ which is the carriage speed between the head unit and the recording medium. As a result, a high-quality print result may be obtained.

3) The inkjet printing apparatus according to the aspect 2) further includes a flying resistance changer that changes a flying resistance of ink droplets by reducing pressure in an ink droplet flying space between the head unit and the mounting unit or by replacing air currently filling the flying space with a gas smaller in specific gravity than the air. The flying resistance changer is prompted by the controller to change the flying resistance of ink droplets based on the carriage speed or the distance changed and set by the distance changing mechanism.

A mean molecular weight of air is approximately 29 g/mol, and a mean atomic weight of helium is approximately 4 g/mol. When a concentration of helium gas in the ink droplet flying space is kept at 60 vol. % or more, a gas density in the ink droplet flying space is reduced to about a half of a gas density when air is filling this space. In the printing apparatus according to the aspect 3), therefore, a longitudinal ejection speed $V_i$ increases to a higher speed than the transverse (Y direction) speed $V_Y$ which is the carriage speed between the head unit and the recording medium. This may diminish adverse impact from the transverse speed $V_Y$ and allow a high-quality print result to be obtained.

4) The inkjet printing apparatus according to the aspect 3) is further characterized in that the plurality of printing modes further include a third printing mode in which the head gap is greater than in the first printing mode, and the carriage speed remains the same as in the first printing mode. In the third printing mode, the flying resistance changer is controlled by the controller to change the flying resistance of ink droplets.

By reducing pressure in the ink droplet flying space between the head unit and the recording medium or by replacing air currently filling the ink droplet flying space with helium gas, air resistance (gas resistance) effected on ink droplets may be reduced. Then, the longitudinal ejection speed $V_i$ increases to a higher speed than the transverse (Y direction) speed $V_Y$, and may accordingly diminish adverse impact from the speed $V_Y$. In the printing apparatus according to the aspect 4), therefore, high-speed printing is feasible at the carriage speed; main scanning speed of the head unit, as fast as in the first printing mode, even with a greater head gap than in the first printing mode.

5) The inkjet printing apparatus according to the aspect 3) is further characterized in that, in the second printing mode, the flying resistance changer is controlled by the controller to change the flying resistance of ink droplets.

By reducing pressure in the ink droplet flying space between the head unit and the recording medium or by replacing air currently filling the ink droplet flying space with helium gas, air resistance (gas resistance) effected on ink droplets may be reduced. Then, the longitudinal ejection speed $V_i$ increases to a higher speed than the transverse (Y direction) speed $V_Y$, and may accordingly diminish adverse impact from the speed $V_Y$. By slowing down the carriage speed; main scanning speed of the head unit, the printing operation may be less affected by the transverse (Y direction) speed $V_Y$ which is the carriage speed between the head unit and the recording medium. As a result, a high-quality print result may be obtained.

The inkjet printing apparatus characterized as described in the aspects 1) to 5) obtains the following effects.

1) The inkjet printing apparatus operable to optionally select one of the printing modes may be equipped for high-resolution and high-speed printing, wide-gap printing, and super wide-gap printing with even greater head gaps. Such an inkjet printing apparatus may be applicable to a broader range of industrial and technical fields.

2) The inkjet printing apparatus may enable high-resolution printing even with head gaps 10 times greater than in the conventional printers. Print mediums that can be handled by such an inkjet printing apparatus may include three-dimensional objects with many irregularities.

3) The inkjet printing apparatus may be equipped to print clear and sharp images with lines of 30 μm or less in width. With such an inkjet printing apparatus, digital printing may be applicable on a full scale to a broader range of printing-related industrial and technical fields.

BRIEF DESCRIPTION OF THE DRAWINGS

FIG. 5 includes FIG. 5A and FIG. 5B.

DETAILED DESCRIPTION OF EMBODIMENTS

Hereinafter, embodiments of this disclosure are described in detail with reference to the accompanying drawings.

FIGS. 1 to 5 all illustrate an embodiment of this disclosure, in which like components are illustrated with like reference signs. These drawings are simplified, with some structural parts being omitted. In these drawings, sizes, thicknesses, and shapes of structural elements may be enlarged or accentuated to a certain extent.

Structural features in part of the inkjet printing apparatus similar to the known art are not described herein or illustrated in detail.

Figures 1, 2:
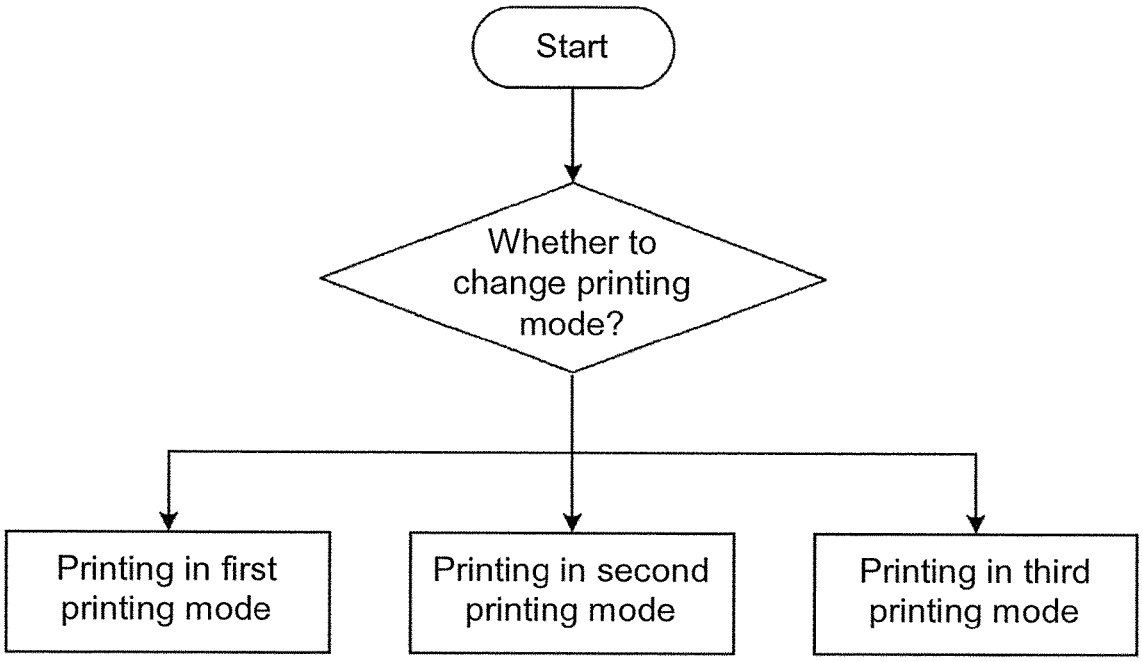
FIG. 1 is a drawing that illustrates selectable printing modes in an inkjet printing apparatus 1 according to a first embodiment of this disclosure.
FIG. 2 is a drawing that illustrates details of the printing modes.

FIG. 1 is a drawing that illustrates selectable printing modes in an inkjet printing apparatus 1 according to a first embodiment of this disclosure. The inkjet printing apparatus 1 has a mode storage (not illustrated in the drawings) in which a plurality of printing modes are storable. The printing mode may be selected by a user manipulating a switch or may be selected by software controlled by a controller 20.

Examples of the printing modes are given below as three printing modes.

First Printing Mode

Regular printing mode (high-speed printing mode): printing mode in which conventional one-pass scans or multi-pass scans are performed.

Second Printing Mode

High-resolution and wide-gap printing mode (low-speed printing mode): printing mode in which a scanning speed of a head that moves relative to a medium (recording medium) is decreased to, for example, one-tenth or less or desirably one-hundredth or less of an initial ejection speed $V_O$ of ink droplets, or scanning is temporarily suspended at the time of ejection of ink droplets. In this printing mode, a head gap is greater than in the first printing mode.

Third Printing Mode

Super wide-gap printing mode (helium-gas atmosphere printing mode): printing mode in which at least a space between positions of ejection and landing of ink droplets is supplied with helium gas, and the scanning speed of the head that moves relative to the medium is decreased to one-tenth or less or desirably one-hundredth or less of the initial ejection speed $V_O$ of ink droplets, or scanning is temporarily suspended at the time of ejection of ink droplets.

The third printing mode may be rephrased that a flying resistance changer is provided that changes a flying resistance of ink droplets by reducing pressure in an ink droplet flying space between a head unit and a mounting unit or by replacing air currently filling the flying space with a gas smaller in specific gravity than the air. The controller prompts the flying resistance changer to change the flying resistance of ink droplets based on a distance changed and set by a distance changing mechanism.

The regular printing mode illustrated in the first printing mode is substantially the same as printing modes typically set and used in the conventional inkjet printers and is not described herein in detail. This printing mode provides a printing speed of 840 mm/sec. under conditions of, for example, a scan frequency of 20 kHz and a nozzle gap of 600 dpi.

FIG. 2 is a table showing details of printing modes that may be available in the inkjet printing apparatus 1 according to this embodiment.

During the first printing mode, the controller 20 prompts a planar direction driving unit to set a carriage speed between a head unit 5 and a mounting unit 10 in a planar direction to, for example, a speed higher than one-tenth of the initial ejection speed of ink droplets.

During the second printing mode, the controller 20 prompts the distance changing mechanism to change a distance between the head unit 5 and the mounting unit 10 (head gap G) to, for example, 3 mm or more, and a traverse speed $V_Y$ of a head that moves relative to a medium is then set to, for example, one-tenth or less or desirably one-hundredth or less of the initial ejection speed $V_O$ of ink droplets.

Possibly, a third printing mode may be further provided, in which the head gap is greater than in the first printing mode and a carriage speed remains the same as in the first printing mode.

In a respective one of the printing modes, atmosphere in the ink droplet flying space may be air or may be replaced with a gas smaller in specific gravity than air, for example, helium gas, or pressure in the flying space may be reduced.

In the third printing mode, high-speed printing is feasible by replacing air in the ink droplet flying space with a gas smaller in specific gravity than air, even with the head gap increased to a certain extent.

As for conditions included in the second printing mode, a head gap G may be allowed to increase as compared with the first printing mode by decreasing the traverse speed $V_Y$ of the head that moves relative to the medium to, for example, one-tenth or less of the initial ejection speed $V_O$ of ink droplets, without having to replace air in the ink droplet flying space with any other gas. As a result, a high-quality print result may be obtained with thick textile fabric or the like.

As for conditions included in the third printing mode, when pressure in the ink droplet flying space is reduced or air in this space is replaced with a gas smaller in specific gravity and a carriage speed between the head unit and the mounting unit is decreased, printing may be successful with the head gap of, for example, 20 mm or more (super wide-gap printing mode illustrated in the third printing mode).

Figure 3:
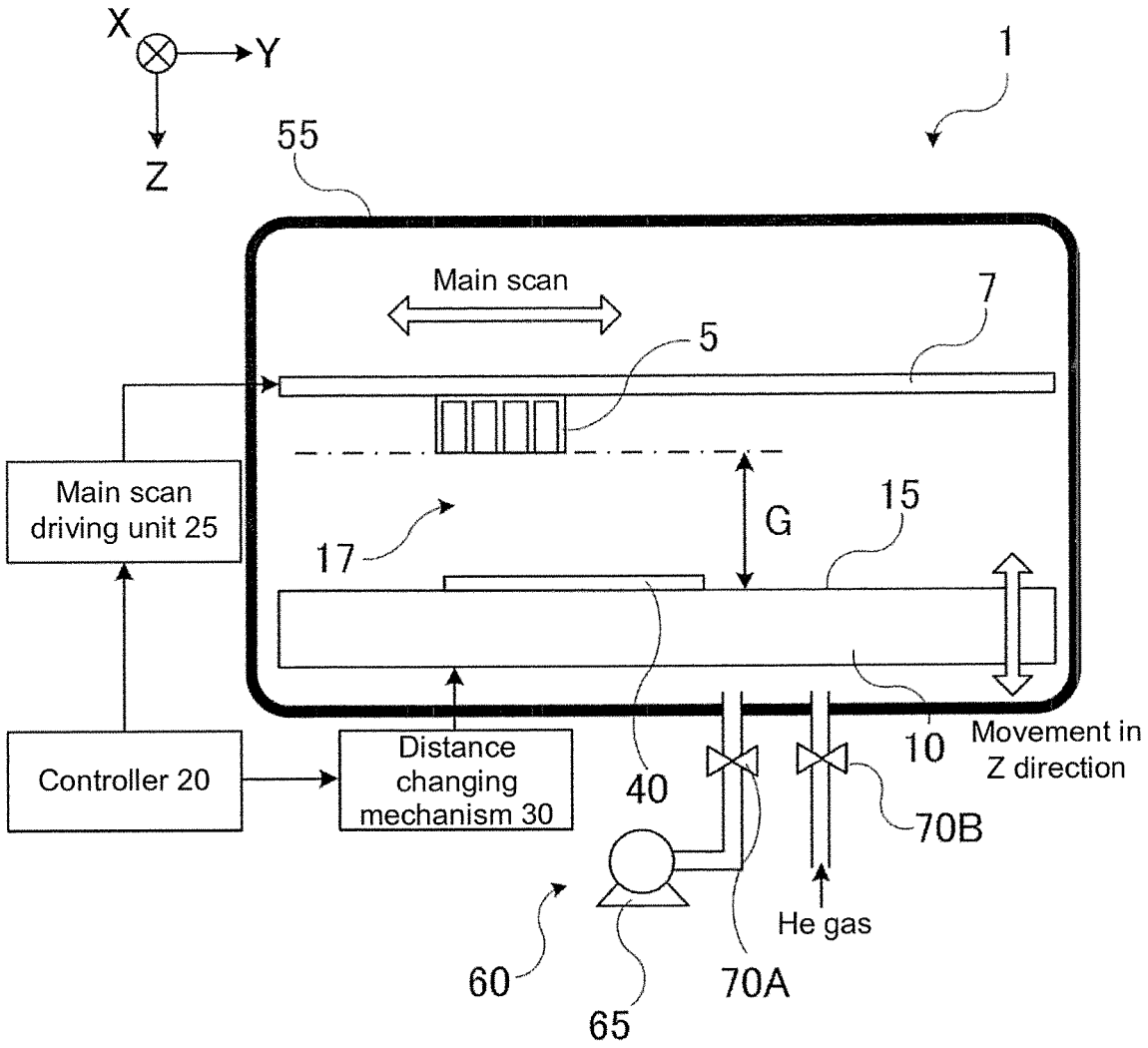
FIG. 3 is a drawing that illustrates an inkjet printing apparatus provided with a distance changing mechanism to change a distance between a head unit and a mounting unit (head gap) and a gas replacement device to replace a gas currently filling an ink droplet flying space with helium gas.

FIG. 3 is a drawing that illustrates the inkjet printing apparatus 1 according to the first embodiment that employs, in addition to the regular printing mode illustrated in the first printing mode, high-resolution and wide-gap printing mode illustrated in the second printing mode and the super wide-gap printing mode illustrated in the third printing mode. FIG. 3 is a front view of the inkjet printing apparatus 1 including a head unit 5 having ink ejection nozzles, a mounting unit 10 that supports a recording medium 40, a distance changing mechanism 30 that changes a distance between the head unit 5 and the mounting unit 10 (head gap G), and a gas replacement device 60 that replaces air in an ink droplet flying space 17 with helium gas.

Specifically, the inkjet printing apparatus 1 includes a head unit 5 that excels in high resolution with a nozzle pitch of 600 dpi or more, a main scan driving unit 25 that drives the head unit 5 to move in a main scanning direction, a mounting unit 10 disposed so to face the head unit 5 and having an upper surface to be mounted with a recording medium, a distance changing mechanism 30 that changes a relative distance between the head unit 5 and the mounting unit 10 (head gap G), and a controller 20 that prompts the main scan driving unit 25 and the distance changing mechanism 30 to operate as set in the second printing mode.

More specifically, the inkjet printing apparatus 1 includes a flat mounting unit 10 on which a recording medium is mountable; a head unit 5 that ejects ink droplets to a recording medium 40; a planar direction driving unit that drives at least one of the head unit 5 ejecting ink droplets and the mounting unit 10 to move in a planar direction parallel to the mounting unit 10 and that changes a relationship between relative positions of the head unit 5 and the mounting unit 10 in the planar direction (main scan driving unit 25 for Y direction); and a height direction driving unit that changes a relationship between relative positions of the head unit 5 and the mounting unit 10 in a height direction perpendicular to the planar direction. The planar direction driving unit has a moving speed changing mechanism that changes a carriage speed between the head unit and the mounting unit in the planar direction. The height direction driving unit has a distance changing mechanism 30 that changes a distance between the head unit 5 and the mounting unit 10 (head gap G). The inkjet printing apparatus 1 further includes a controller 20 that controls the carriage speed changed by the moving speed changing mechanism based on the distance changed and set by the distance changing mechanism 30.

The head unit 5, being guided by a guide rail 7, performs scans in the main scanning direction (Y direction). A distance between the head unit 5 and an upper surface 15 of mounting unit (head gap G) is changeable in the range of, for example, 3 mm to 20 mm, by the distance changing mechanism 30.

This may be rephrased that the main scan driving unit 25 changes a relationship between relative positions of the head unit 5 and the mounting unit 10 in the main scanning direction.

Two driving units that drive the head unit 5 to move within a plane parallel to the mounting unit 10; main scan driving unit 25, and sub scan driving unit 155 (see FIG. 5A described later), are collectively referred to as a planar direction driving unit.

As described earlier, the inkjet printing apparatus 1 further has the gas replacement device 60 to replace air in the ink droplet flying space 17 with helium gas, or the like. The gas replacement device 60 includes an isolation chamber 55 that encapsulates the head unit 5 and the mounting unit 10, and a vacuum pump 65 that suctions air out of the isolation chamber 55. A helium gas tube is coupled to the gas replacement device 60 to introduce helium gas into the isolation chamber 55. The vacuum pump 65 and the helium gas tube respectively have a valve 70A and a valve 70B which are controlled by the controller 20 so as to replace air in the ink droplet flying space 17 with helium gas.

The high-resolution and wide-gap printing mode illustrated in the second printing mode is hereinafter described.

Figure 6:
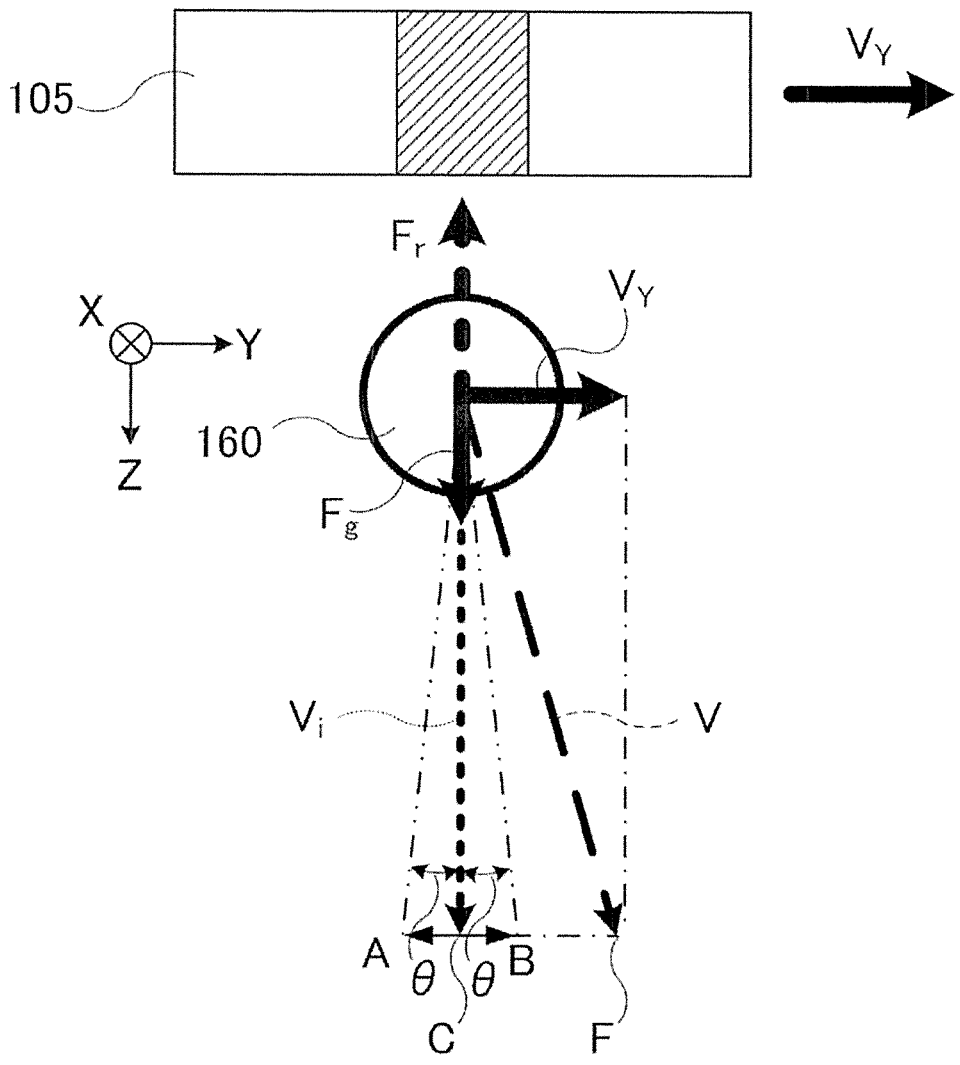
FIG. 6 is a drawing that illustrates how scanning by a head unit affects a trajectory of an ink droplet.
Figure 7:
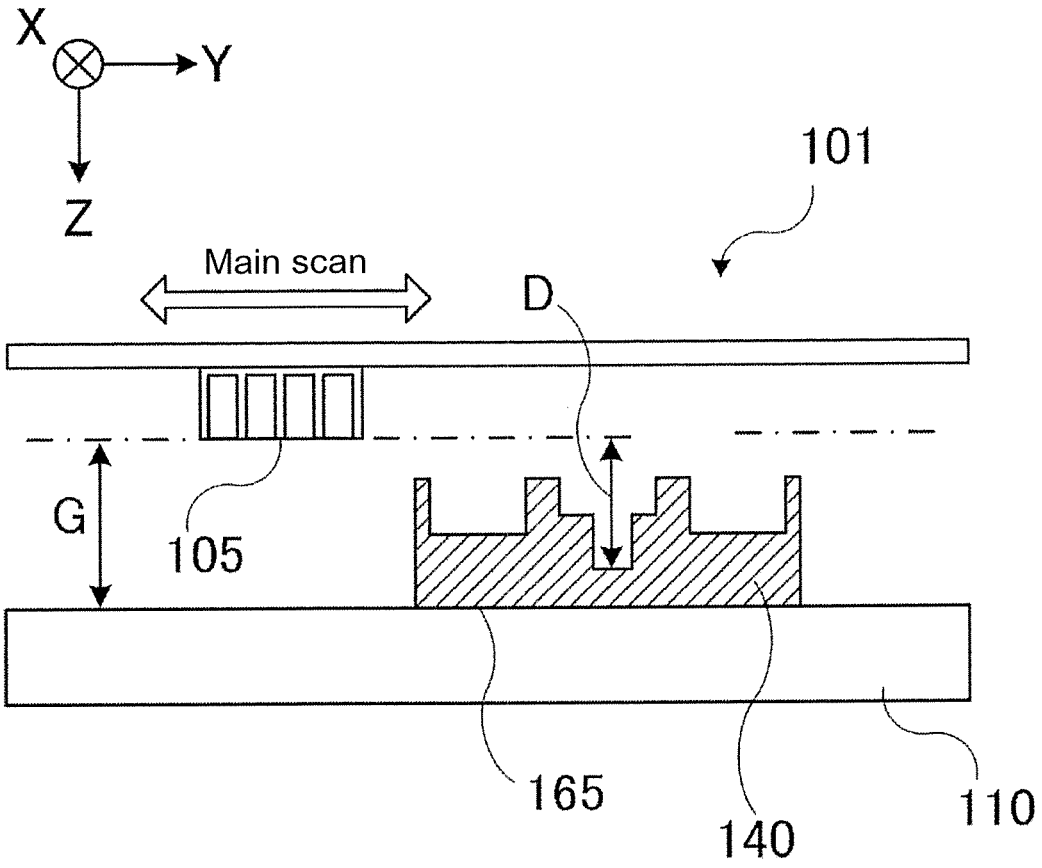
FIG. 7 is a drawing that illustrates issues to be addressed with a recording medium with large irregularities.

As illustrated in FIG. 6, the ink droplet ejected at the initial ejection speed $V_O$ in Z direction (longitudinal direction) from the head unit 5 moving in the main scanning direction (Y direction) at the speed $V_Y$, while being decelerated by air resistance, flies toward the recording medium 40. Supposing that $V_i$ is a speed of the ink droplet in the Z direction, i.e., longitudinal ejection speed, the ink droplet ejected flies at a composite speed V of the speeds $V_i$ and $V_Y$. The longitudinal ejection speed $V_i$ of the ink droplet in the Z direction decelerated by air resistance is expressed by $V_i=V_O\exp(-t/\tau)$. The value "τ" is a time constant of deceleration, typically ranging from approximately several msec. to several dozen msec, and is shorter with smaller ink droplets. Thus, smaller ink droplets are more quickly decelerated.

As is known from FIG. 6, the landing position of an ink droplet further shifts in the direction of the traverse speed $V_Y$ with smaller values of $V_i$, and is more greatly affected by variability of an ejection angle and the initial ejection speed of the ink droplet. It is further known from this drawing that, when the speed $V_Y=0$, the ink droplet may land at the same position irrespective of the speed $V_i$. In the high-resolution and wide-gap printing mode illustrated in the second printing mode, the speed $V_Y$ is set to zero or a value adequately smaller than $V_i$, for example, 0.1 m/sec. or less.

A stepping motor may be used for transport of the head unit 5 to allow $V_Y=0$, in which case scans by the head unit 5 may be suspended at the time of ink ejection. In case the high-resolution and wide-gap printing mode illustrated in the printing mode B is limited to low-speed printing, the main scan driving unit, using a combination of a low-speed linear motor and an encoder, decreases the main scanning speed to, for example, one-tenth or less or desirably one-hundredth or less of the initial ejection speed $V_O$ of the ink droplets. Specifically, the main scan driving unit decreases the main scanning speed; carriage speed in the main scanning direction between the head unit 5 and the mounting unit 10, to one-tenth or less or desirably one-hundredth or less of the initial ejection speed $V_O$ of the ink droplets, or the main scan driving unit sets the main scanning speed to zero.

In the high-resolution and wide-gap printing mode illustrated in the second printing mode, the printing speed is decreased, for example, to approximately one-tenth to one-hundredth of the initial ejection speed. Therefore, the following actions may be effective in this mode.

The head unit 5 may preferably include a high-resolution head that achieves the resolution of a final print result, so that multi-pass printing for higher resolution becomes unnecessary. This may allow high-resolution images to be printed in one to four passes. There are known banding-preventive means available for one-pass to four-pass serial printers, any one of which may be employed to avoid the occurrence of banding.

In the high-resolution and wide-gap printing mode illustrated in the second printing mode, the printing speed is 42 mm/sec., under conditions of, for example, scan frequency of 1 kHz and nozzle gap of 600 dpi.

While the head unit 5 of FIG. 3 is designed for serial printers, a line printer may be optionally used, in which the head unit 5 may be immovably positioned, as described later, insofar as the mounting unit 10 is movable in the planar direction which is X-Y direction in FIG. 3.

The controller 20 includes CPU, RAM, and ROM and in charge of various operational controls. The CPU is a central processing unit that executes various functions by running programs. The RAM is used as a working region and a storage region for the CPU. In the ROM are stored an operation system and programs to be executed by the CPU.

The super wide-gap printing mode illustrated in the third printing mode is hereinafter described. During the super wide-gap printing mode illustrated in the third printing mode, gas in the ink droplet flying space 17 of the isolation chamber 55 is replaced with helium gas by the gas replacement device 60.

The gas replacement device 60 keeps a concentration of helium gas in the ink droplet flying space 17 of the isolation chamber 55 at 60 vol. % or more, or preferably at 90 vol. % or more. Optionally, a helium gas densitometer may be provided in the isolation chamber 55 in order to keep a constant concentration of helium gas in the ink droplet flying space 17. Then, the controller 20 may control a gas concentration in the isolation chamber 55 based on the concentration of helium gas measured by the helium gas densitometer.

Figure 4:
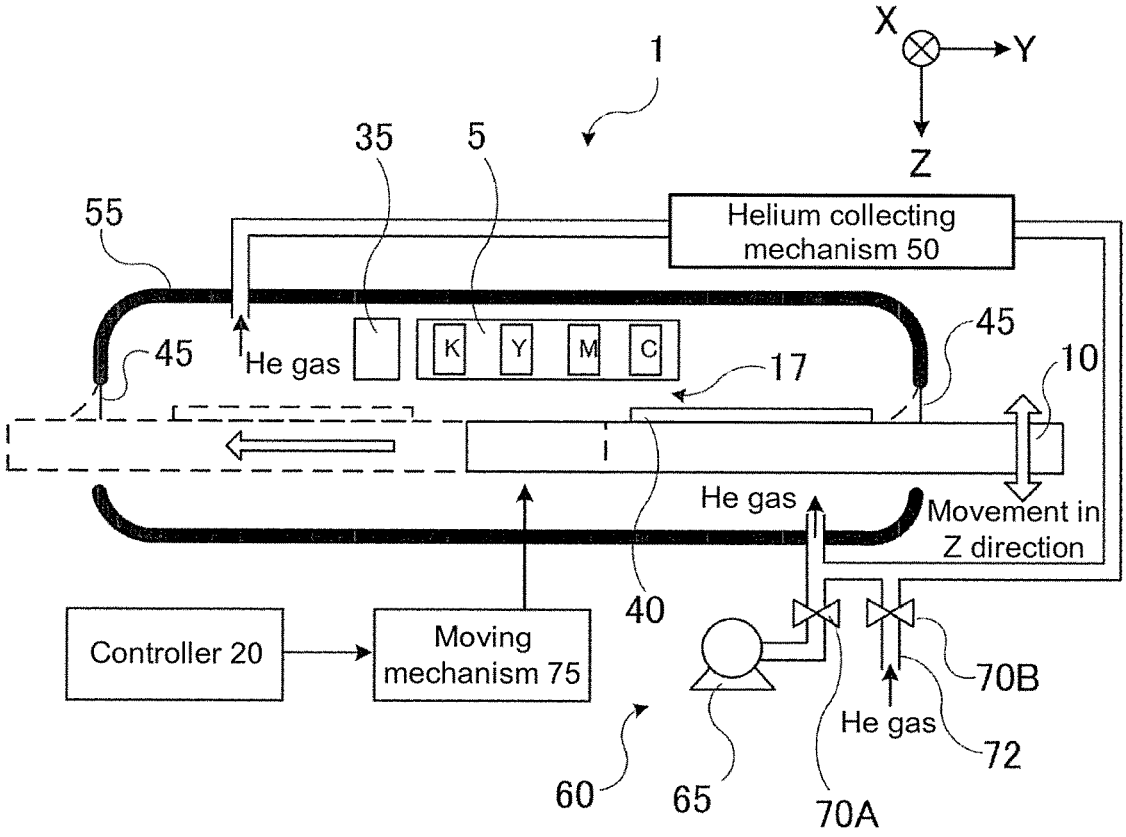
FIG. 4 is a drawing that illustrates an inkjet printing apparatus according to a second embodiment of this disclosure and a printing mode in which the ink droplet flying space is supplied with helium gas by the gas replacement device.
Figure 5A:
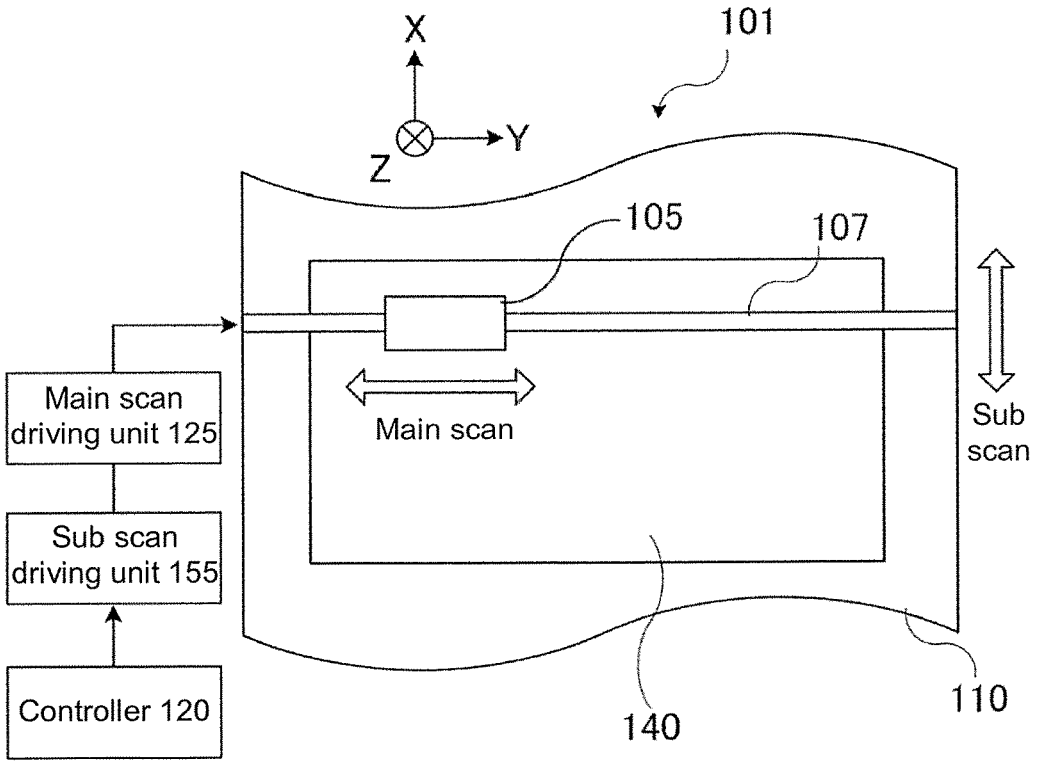
FIG. 5A is an upper view of a conventional inkjet printing apparatus.
Figure 5B:
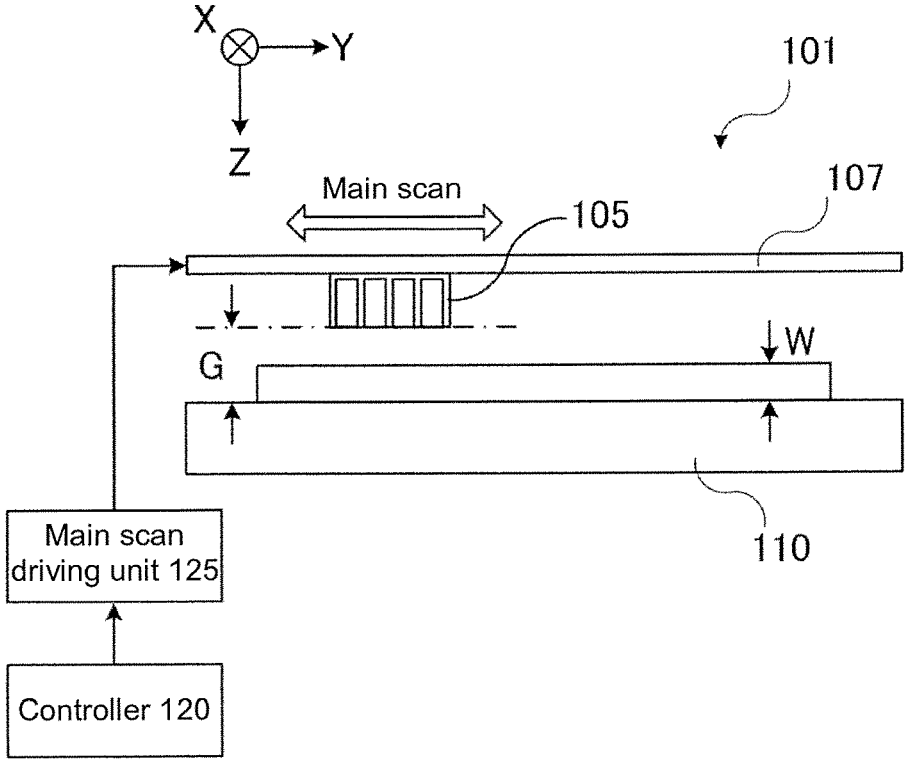
FIG. 5B is a drawing that illustrates a conventional head gap in inkjet printing.

FIG. 4 is a drawing of an inkjet printing apparatus 1 according to a second embodiment of this disclosure. The inkjet printing apparatus 1 includes a head unit 5 from which ink is ejected, a mounting unit 10 having an upper surface to be mounted with a recording medium 40, a moving mechanism 75 that moves the mounting unit 10 in X-Y direction illustrated in FIG. 4 which is horizontal direction, and a distance changing mechanism 30 (not illustrated in the drawing) that changes a relative distance between the head unit 5 and the mounting unit 10 (head gap G). The inkjet printing apparatus 1 includes an isolation chamber 55 that isolates the ink droplet flying space 17 between the head unit 5 and the recording medium 40 from atmospheric air, a moving mechanism 75 that moves the mounting unit 10 in X-Y direction illustrated in the drawing which is horizontal direction, a gas replacement device 60 that replaces gas in the ink droplet flying space 17 of the isolation chamber 55 with helium gas, and a helium collecting mechanism 50. The isolation chamber 55 has a rubber curtain 45 for prevention of helium leakage. This rubber curtain 45 abuts the mounting unit 10 to prevent helium gas from leaking outside. The gas replacement device 60 includes a vacuum pump 65 for replacement of gas in the isolation chamber 55, and a valve 70B for control of helium gas supplied from a helium gas tube 72. The inkjet printing apparatus 1 may reduce running costs by recycling helium gas in the isolation chamber 55.

The inkjet printing apparatus 1 according to the second embodiment is a line printer in which the head unit 5 is immovably positioned. In this printing apparatus, the mounting unit 10 supporting a lower part of the recording medium 40 is allowed to move on X-Y plane. The head unit 5 excels in resolution with a nozzle pitch of 600 dpi or more.

This printing apparatus having the head unit 5 thus immovably positioned may avoid possible vibration of the head unit 5 performing scans and associated adverse impact. To prevent the relative movement between the head unit 5 and the mounting unit 10 from affecting ink droplets ejected from the head unit 5, the mounting unit 10 may be temporarily halted while the ink droplets ejected are yet to land on the medium or may be moved at a low speed decreased to, for example, one-tenth or less or desirably one-hundredth or less of the initial ejection speed $V_O$ of the ink droplets.

In the operation illustrated in FIG. 4, ink ejected from the head unit 5 is essentially UV photo-curable ink curable under UV irradiation, and the inkjet printing apparatus 1 is provided with a UV light source 35. However, ink used in this printing apparatus is not limited to such UV photo-curable ink. For example, the ink used may be aqueous ink or solvent ink or may be ink polymerizable under irradiation of electronic radiation or the like. The head unit 5 has nozzles that eject inks having different colors, for example, K (black), Y (yellow), M (magenta), and C (cyan) color inks.

Next, the gas replacement device 60 of the inkjet printing apparatus 1 according to the second embodiment is hereinafter described in detail. The gas replacement device 60 keeps the concentration of helium gas in the ink droplet flying space 17 of the isolation chamber 55 at 60 vol. % or more or preferably at 90 vol. % or more by controlling a vacuum pump 65, a valve 70A for gas suctioning, and a valve 70B coupled to a helium gas tube 72. Optionally, a helium gas densitometer may be provided in the isolation chamber 55 in order to keep a constant concentration of helium gas in the ink droplet flying space 17. Then, the controller 20 may control the gas concentration in the isolation chamber 55 based on the concentration of helium gas measured by the helium gas densitometer.

The inkjet printing apparatus 1, by moving the mounting unit 10, carries out the printing operation in accordance with the super wide-gap printing mode illustrated in the third printing mode. In the super wide-gap printing mode, at least the ink droplet flying space 17 between positions of ejection and landing of ink droplets is supplied with helium gas, and a carriage speed between the head unit 5 and the recording medium 40 is decreased to one-tenth or less or desirably one-hundredth or less of an initial ejection speed $V_O$ of ink droplets, or scanning is temporarily suspended (carriage speed of zero) at the time of ejection of ink droplets.

In the third printing mode, the density of helium gas is approximately one-seventh of air. Then, gas resistance against ink droplets before landing is decreased to a half or one-third as compared with air, and ink droplets may be accordingly decelerated to a lesser extent. When the super wide-gap printing mode is set, a head gap that allows for high-resolution and stable printing may be increased to a length approximately twice or three times greater than a length with air. Specifically, high-resolution printing with a head gap greater than, for example, 20 mm is feasible.

By removing oxygen-containing air from the ink droplet flying space 17 and filling this space with helium which is an inactive gas, a high-value-added inkjet printing apparatus is provided that may improve printing safety and that may be combined with laser cutting printers that leave no burn mark.

This disclosure provides a method in which three printing modes including a regular printing mode are selectively used to offer a user different printing options; high-speed printing with narrow head gap, high-resolution and wide-gap printing, and super wide-gap printing, depending on applications of use and purposes.

The inkjet printing apparatus according to this embodiment has a mode storage (not illustrated in the drawings) in which operations in different printing modes are storable. Therefore, this one inkjet printing apparatus alone may be allowed to handle various printing options by selecting a suitable one of the printing modes, for example, suitable for high-speed and high-resolution printing or a recording medium that requires a large head gap.

Typical inkjet printing apparatuses may employ a nozzle pitch of, for example, 150 dpi and achieve a high resolution through multi-pass printing. For example, 600 dpi is feasible in four-pass printing. In case the head unit with ink ejection nozzles performs a scan, the ink droplet landing position may become inaccurate under the impact from the scanning speed in the Y direction. Vibration generated by the scan per se may be another factor leading to failure to obtain a sharp, clear print result. The inkjet printing apparatus 1 according to this embodiment using the high-resolution head unit 5 with a nozzle pitch of 600 dpi or more may effectively prevent sharpness of a print result from degrading due to the scan by employing single-pass printing or a small number of scans or by fixing the position of the head unit 5.

By further providing the distance changing mechanism 30 that changes the relative distance between the head unit 5 and the mounting unit 10 (head gap G), recording mediums 40 large in thickness may be used by adjusting the distance between the head unit 5 and the upper surface 15 of the mounting unit 10 (head gap G).

While the head unit and the mounting unit are moving relative to each other in the main scanning direction, ink droplets ejected are affected by velocity components in the main scanning direction generated by the relative movement. In the inkjet printing apparatus 1 according to this embodiment, the main scan driving unit decreases the main scanning speed to one-tenth or less of the initial ejection speed of ink droplets, or to zero in some cases, in at least one of the printing modes. This may effectively diminish possible disturbance of ink droplets ejected in the main scanning direction (Y direction).

In the inkjet printing apparatus 1 according to this embodiment, the distance between the head unit 5 and the upper surface 15 of the mounting unit (head gap G) may be changed to, for example, 3 mm or more in at least one of the printing modes, therefore, recording mediums 40 large in thickness may be used as print medium.

After air currently filling the ink droplet flying space 17 between the head unit 5 and the recording medium 40 is replaced with helium gas, a force imposed on ink droplets by air resistance (gas resistance) may be decreased to a half or one-third of a force in the case of air. Then, the longitudinal ejection speed $V_i$ may increase to a higher speed than the transverse (Y direction) speed $V_Y$; carriage speed between the head unit and the recording medium. This may diminish adverse impact from the speed $V_Y$. The inkjet printing apparatus according to this embodiment, therefore, may be allowed to increase the distance between the head unit 5 and the upper surface 15 of the mounting unit (head gap G) without losing desired sharpness of a print result. When the speed $V_Y$ is further decreased to one-tenth or less of the initial ejection speed of ink droplets, the distance between the head unit 5 and the upper surface 15 of the mounting unit (head gap G) may be effectively further widened to 20 mm or more. This may be rephrased that, in a printing mode in which the following conditions are combined; high-resolution head unit 5 with a nozzle pitch of 600 dpi or more, lower main scanning speed, replacement of the gas in the ink droplet flying space 17 with helium gas, high-resolution inkjet printing leading to a print result that excels in sharpness may be performed even with recording mediums having irregularities and large thicknesses W, for example, textile mediums.

A mean molecular weight of air is approximately 29 g/mol, and a mean atomic weight of helium is approximately 4 g/mol. When the concentration of helium gas in the ink droplet flying space 17 is kept at 60 vol. % or more, a gas density in the ink droplet flying space may be reduced to about a half of a gas density when air is filling this space. In the inkjet printing apparatus 1 according to this embodiment, the longitudinal ejection speed $V_i$ increases to a higher speed than the transverse (Y direction) speed $V_Y$, and adverse impact from the transverse speed $V_Y$ may be accordingly diminished.

The inkjet printing apparatus 1 disclosed herein is not necessarily configured structurally and technically as described in the embodiments, and may be variously modified within the scope of what is described herein.

For example, possible combinations of the printing modes in the inkjet printing apparatus 1 may include a combination of the regular printing mode and either one of the high-resolution and wide-gap printing mode illustrated in the second printing mode and the super wide-gap printing mode illustrated in the third printing mode for certain applications of use.

Types of the recording medium 40 and means for medium transport are not particularly limited. Examples of transport means may include but are not limited to roll-to-roll, flatbed, and sheeting.

Types of the inkjet printing apparatus may include but are not limited to serial printers, flatbed printers, and line head printers.

Materials of the recording medium 40 may be any one selected from paper, plastics, rubbers, leathers, metals, glass, fabrics, building materials, interior materials, three-dimensional objects, and the like.

To maximize functions attainable by the high-resolution and wide-gap printing mode and super wide-gap printing mode, vibration of the printing apparatus is desirably reduced to minimum. In this regard, a printer configured to fix a head and move a print medium mounted on a flatbed is more suitable than a printer with a movable head-mounted carriage, because such a printer may allow a high-resolution print result to be obtained with a wider head gap, without the risk of possible vibration of and wind generated by the moving head.

Means for ink ejection from the head may include but is not limited to piezo and thermal inkjet systems, electrostatic suctioning, and dispensing.

The high-resolution and wide-gap printing mode illustrated in the second printing mode and super wide-gap printing mode illustrated in the third printing mode may offer improved printability with ink droplets of 1 pL or less which conventionally had to be atomized or demanded a smaller head gap in order to avoid inaccuracy of landing positions. Therefore, a super high-resolution print result with line widths of 50 μm or less may be successfully obtained.

Examples of usable ink may include but are not limited to aqueous inks, UV-curable inks, SUV (solvent-diluted UV inks), latex inks, and instantaneous drying inks. Other usable inks may include color inks, colorless inks, white inks, and inks in metallic or fluorescent colors.

It may be suggested to further provide a helium gas collecting mechanism with a membrane filter for recycling of helium gas.

The inkjet printing apparatus 1 according to the embodiments described thus far may be applicable to a broad range of printing applications using, for example, wide format printers for sign display, industrial flatbed printers, and textile printers for outfits such as T-shirts and uniforms. The inkjet printing apparatus 1 may be particularly useful in direct printing with mediums having irregularities.

What is claimed is:

1. An inkjet printing apparatus, comprising:

a mounting unit having a flat shape on which a recording medium is mountable;

a head unit that ejects ink droplets to the recording medium;

a planar direction driving unit that drives at least one of the head unit ejecting the ink droplets and the mounting unit to move in a planar direction parallel to the mounting unit and that changes a relationship between relative positions of the head unit and the mounting unit in the planar direction, wherein the planar direction driving unit comprises a moving speed changing mechanism that changes a carriage speed between the head unit and the mounting unit in the planar direction;

a flying resistance changing mechanism that changes a flying resistance of the ink droplets by reducing pressure in an ink droplet flying space between the head unit and the mounting unit or by replacing air currently filling the ink droplet flying space with a gas having a smaller specific gravity than a specific gravity of the air; and a controller that controls the carriage speed based on the flying resistance set by the flying resistance changing mechanism.

2. The inkjet printing apparatus according to claim 1, further comprising a distance changing mechanism that changes a head gap which is a distance between the head unit and the mounting unit, wherein the controller further changes the carriage speed based on the distance set by the distance changing mechanism.

3. The inkjet printing apparatus according to claim 1, wherein oxygen is removed from the ink droplet flying space by the flying resistance changing mechanism.

4. The inkjet printing apparatus according to claim 1, wherein the planar direction driving unit fixes the head unit and moves merely the mounting unit.

5. The inkjet printing apparatus according to claim 1, wherein printing is performed by ejecting ink droplets from the head unit onto the recording medium, and the printing is performed by a single-pass printing.

6. The inkjet printing apparatus according to claim 1, wherein the gas having a smaller specific gravity than a specific gravity of the air is helium gas, and a concentration of the helium gas in the ink droplet flying space is kept at 60 vol. % or more.

* * * * *